US006401683B1

(12) United States Patent
Stokes et al.

(10) Patent No.: US 6,401,683 B1
(45) Date of Patent: Jun. 11, 2002

(54) MULTIPLE SHAFT ENGINE

(75) Inventors: Nigel Cameron Stokes; Warwick James Stokes, both of New South Wales (AU)

(73) Assignee: Nigel Stokes Pty Ltd. (AU)

( * ) Notice: Subject to any disclaimer, the term of this patent is extended or adjusted under 35 U.S.C. 154(b) by 0 days.

(21) Appl. No.: 09/622,507

(22) PCT Filed: Feb. 20, 1998

(86) PCT No.: PCT/AU98/00109

§ 371 (c)(1),
(2), (4) Date: Oct. 12, 2000

(87) PCT Pub. No.: WO98/37309

PCT Pub. Date: Aug. 27, 1998

(30) Foreign Application Priority Data

Feb. 20, 1919 (AU) ..... PO 5194

(51) Int. Cl.[7] ..... F01B 9/02
(52) U.S. Cl. ..... 123/197.1
(58) Field of Search ..... 123/197.1; 74/437

(56) References Cited

U.S. PATENT DOCUMENTS

| | | | | | |
|---|---|---|---|---|---|
| 3,301,244 | A | * | 1/1967 | Renshaw | 123/197.1 |
| 3,769,946 | A | * | 11/1973 | Sherrer | 74/437 |
| 3,894,615 | A | * | 7/1975 | Lew | 74/437 |
| 4,437,438 | A | | 3/1984 | Mederer | |
| 5,170,757 | A | | 12/1992 | Gamache | |
| 5,517,931 | A | * | 5/1996 | Kawaguchi | 74/437 |
| 5,542,308 | A | * | 8/1996 | Miller | 74/437 |
| 5,557,934 | A | | 9/1996 | Beach | |
| 6,021,683 | A | * | 2/2000 | Doege et al. | 74/437 |

FOREIGN PATENT DOCUMENTS

| | | |
|---|---|---|
| AU | 1581920 | 5/1920 |
| AU | 1989824 | 10/1924 |
| AU | 61651 | 4/1951 |
| BE | 864208 | 3/1978 |
| DE | 3205495 | 8/1983 |
| DE | 3226977 | 1/1984 |
| DE | 4243306 | 6/1994 |
| WO | 9701694 | 4/1997 |

* cited by examiner

*Primary Examiner*—Marguerite McMahon
*Assistant Examiner*—Jason Benton
(74) *Attorney, Agent, or Firm*—Webb Ziesenheim Logsdon Orkin & Hanson, P.C.

(57) ABSTRACT

An internal combustion reciprocating engine including a drive shaft, at least one piston, and a piston coupling corresponding to each piston wherein each coupling includes: a crank rotatably coupled to the piston, a first and second toothed crank cam gear fixedly coupled to the crank, a first and second complementary toothed drive cam gear fixedly coupled to the drive shaft and drivingly engaged with the corresponding first and second crank cam gears for at least a first and second portion, respectively, of a complete revolution of the drive shaft so linear movement of the piston is converted to rotation of the drive shaft.

5 Claims, 18 Drawing Sheets

MULTIPLE SHAFT ENGINE

FIELD OF THE INVENTION

This invention relates to a mechanism for application to internal combustion engines.

The mechanism concerns a piston and drive shaft coupling. The coupling communicates energy from the piston to an engine's drive shaft in a manner that permits the piston to move in a predetermined characteristic different from the generally sinusoidal characteristic resulting from a conventional piston coupling.

This mechanism may be applied to either a two-stroke or four-stroke internal combustion engine.

BACKGROUND

It is known in multi-cylinder internal combustion piston engines to provide a single crankshaft to which each piston is attached by means of a connecting rod. When the crankshaft is rotating at constant speed, each upstroke and downstroke of the piston has the same duration. The movement of each piston is characterised approximately by a sine wave which indicates the position of the piston in the cylinder as a function of the rotational position of the drive shaft.

It is desirable for a number of reasons including optimising combustion efficiency, increasing fuel economy, maximising power output, increasing torque, reducing mechanical stresses, or generally enhancing tuning flexibility to be able to modify the characteristic relationship between the motion of the piston and the drive shaft. Hitherto, attempts to do this have been largely unsuccessful.

It is an object of the present invention to overcome or substantially ameliorate one or more of the disadvantages of the prior art, or at least to provide a useful alternative.

SUMMARY OF THE INVENTION

According to a first aspect of the invention, there is provided an internal combustion engine including:

- a drive shaft;
- a crank including a crank pin;
- a piston mounted for reciprocation within a cylinder;
- a connecting rod extending between the piston and the crank pin;
- a first crank gear mounted on the crank; and
- a first drive gear mounted on the drive shaft;
- wherein the first crank gear and the first drive gear form a first gear pair;
- wherein said first gear pair is drivingly engaged for at least a first portion of a complete revolution of the drive shaft; and
- wherein at least one of the first crank gear and the first drive gear of said first gear pair is non-elliptical;
- such that reciprocation of the piston causes rotation of the drive shaft in a relationship determined by the respective profiles of the crank gear and the drive gear of the first gear pair.

Preferably, the first drive gear and the first crank gear have an equal number of teeth so that one revolution of the crank gear produces one revolution of the drive shaft. Preferably also, the crank gear and the drive gear are both non-elliptical.

In one preferred embodiment, one or other of the drive gear and the crank gear is eccentrically mounted to the drive shaft or the crank respectively. Alternatively, both the drive gear and the crank gear may be eccentrically mounted. In a preferred form, the crank gear is integral with the crank.

In another preferred form, the engine further includes:

- a second crank gear mounted to the crank; and
- a second complementary drive gear mounted to the drive shaft;
- wherein said second crank gear and second drive gear form a second gear pair;
- wherein the second gear pair is drivingly engaged for at least a second complementary portion of a complete revolution of the drive shaft; and
- wherein at least one of the second crank gear and the second drive gear of said second gear pair is non-circular;
- such that reciprocation of the piston causes rotation of the drive shaft in a relationship determined by the profiles of the crank gears and the drive gears of the respective first and second gear pairs.

More preferably, the first and second crank gears are different in circumferential length. The first and second drive gears are preferably formed as a single composite gear having a first portion engaged with the first crank gear for the duration of one complete revolution of the crank, and a second portion engaged with the second crank gear for the duration of a subsequent complete revolution of the crank, thereby providing one drive shaft revolution per two crank gear revolutions.

Still more preferably, the crank gear and the drive gear of each gear pair are both non-circular. In other preferred forms, one or both of the gears of each gear pair are eccentrically mounted respectively to their drive shaft or crank.

In a further preferred form, the engine includes a plurality of pistons and a single drive shaft, wherein each piston has an associated crank including a crank pin, a connecting rod extending between the piston and the crank pin, a first crank gear mounted to the crank and a first drive gear mounted to the drive shaft.

Still more preferably, all of the respective cranks are joined by a single crankshaft having a plurality of crank pins.

DRAWINGS

A preferred embodiment of the invention will now be described, by way of example only, with reference to the following drawings in which.

DETAILED DESCRIPTION OF THE DRAWINGS

Figure 1:
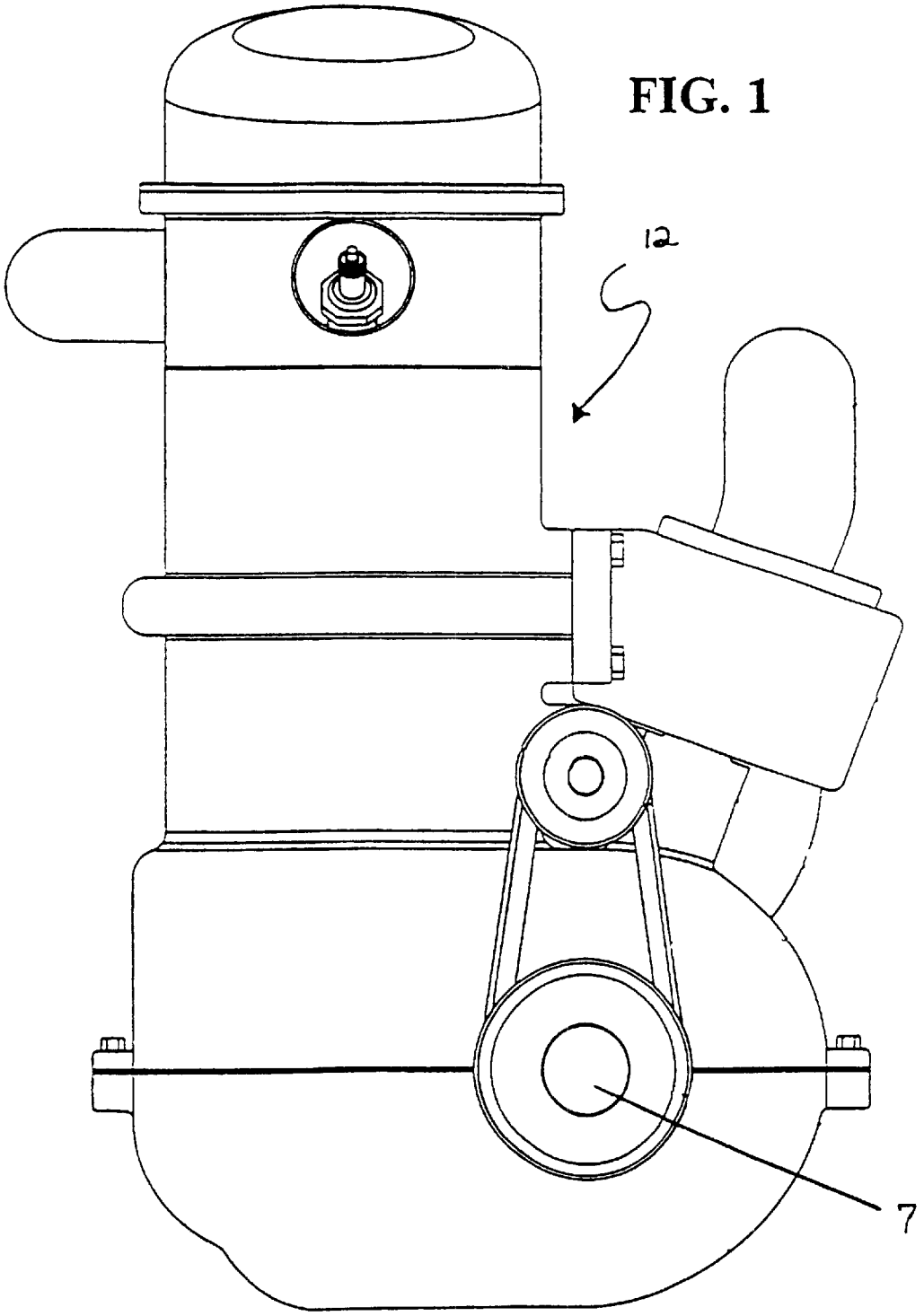
FIG. 1 illustrates a front view of a two stroke internal combustion engine in accordance with the invention.
Figure 2:
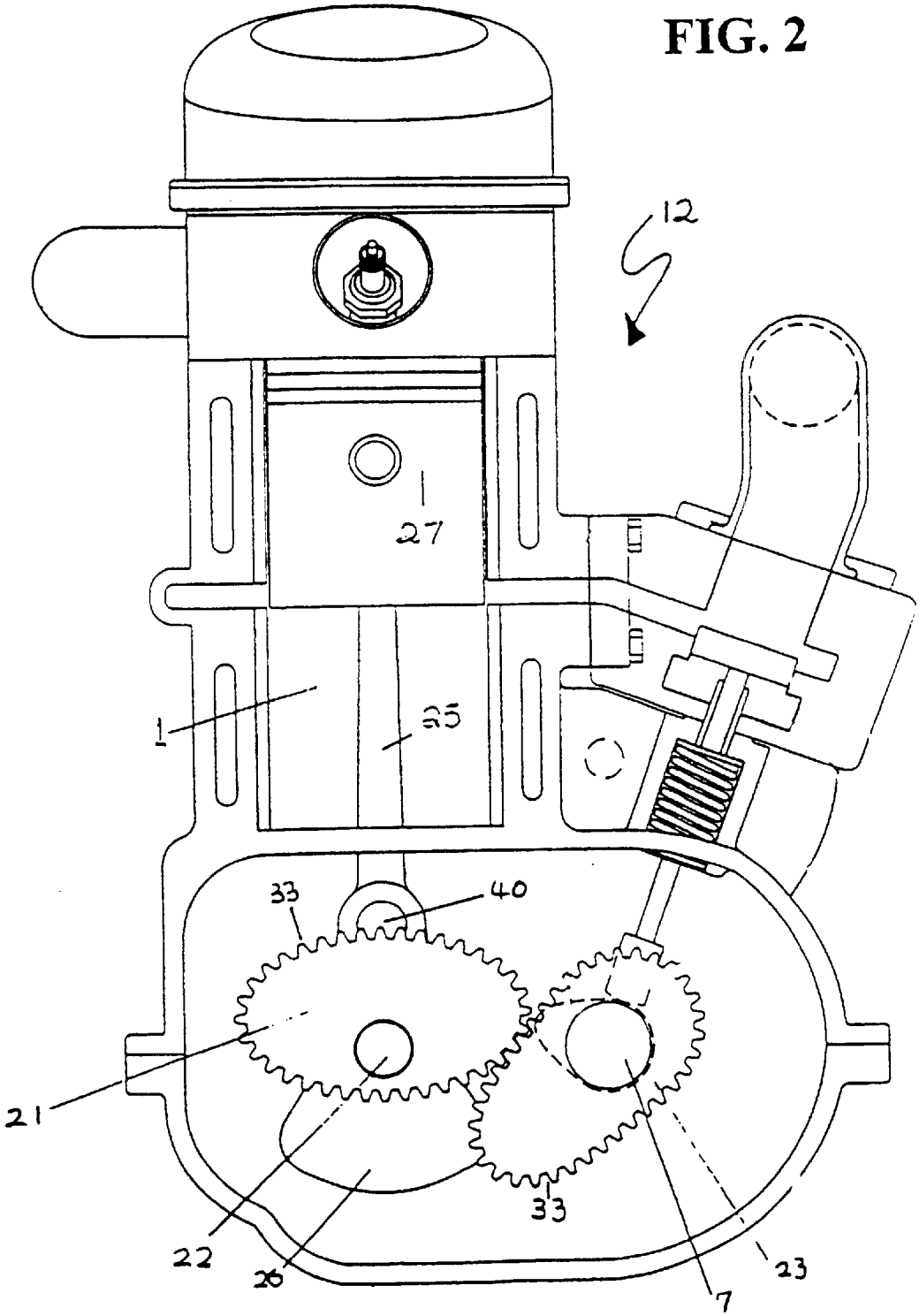
FIG. 2 illustrates a partially cut away view of the engine of FIG. 1.
Figure 3:
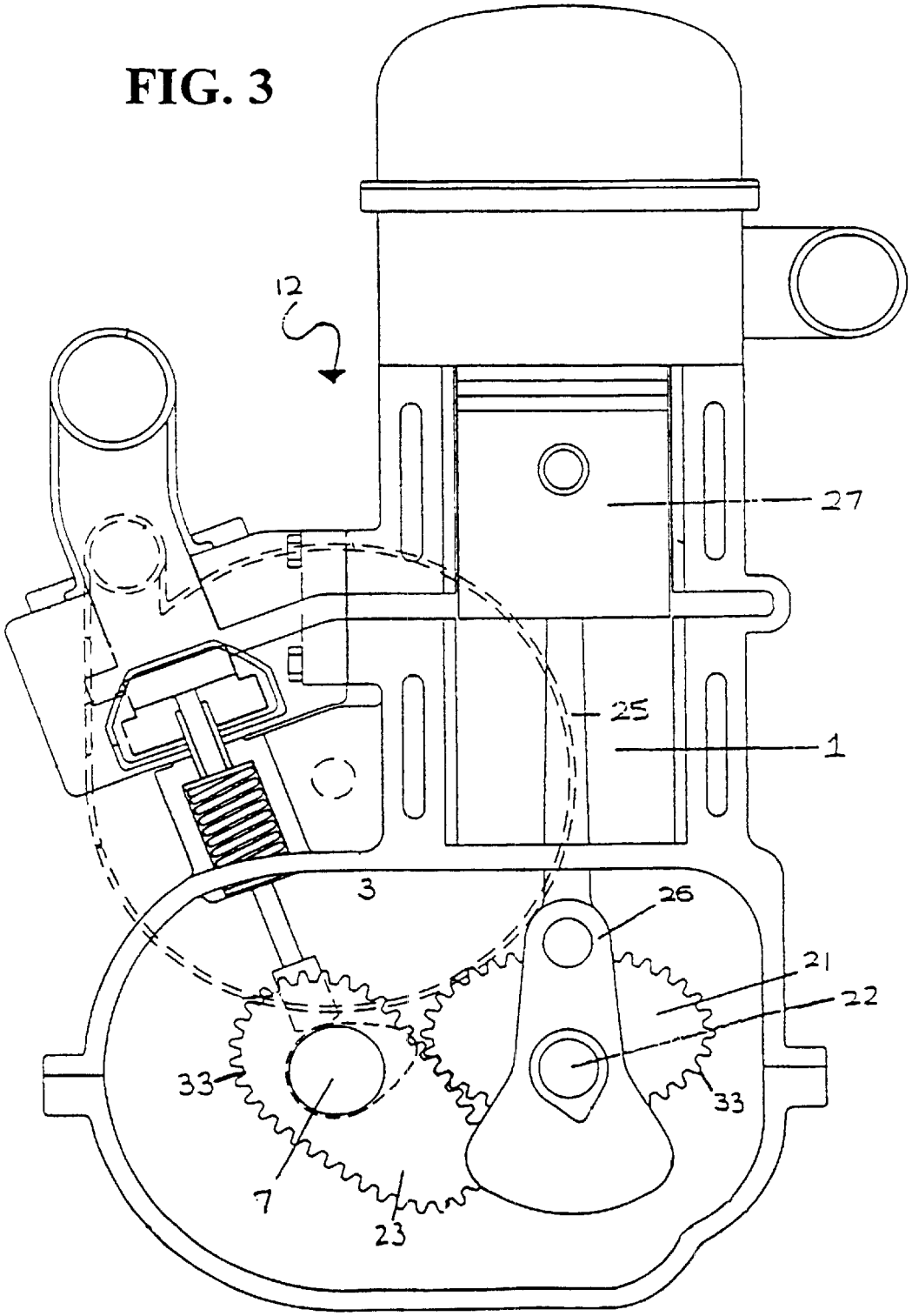
FIG. 3 illustrates a partially cut away rear view of the engine of FIGS. 1 and 2.
Figure 4:
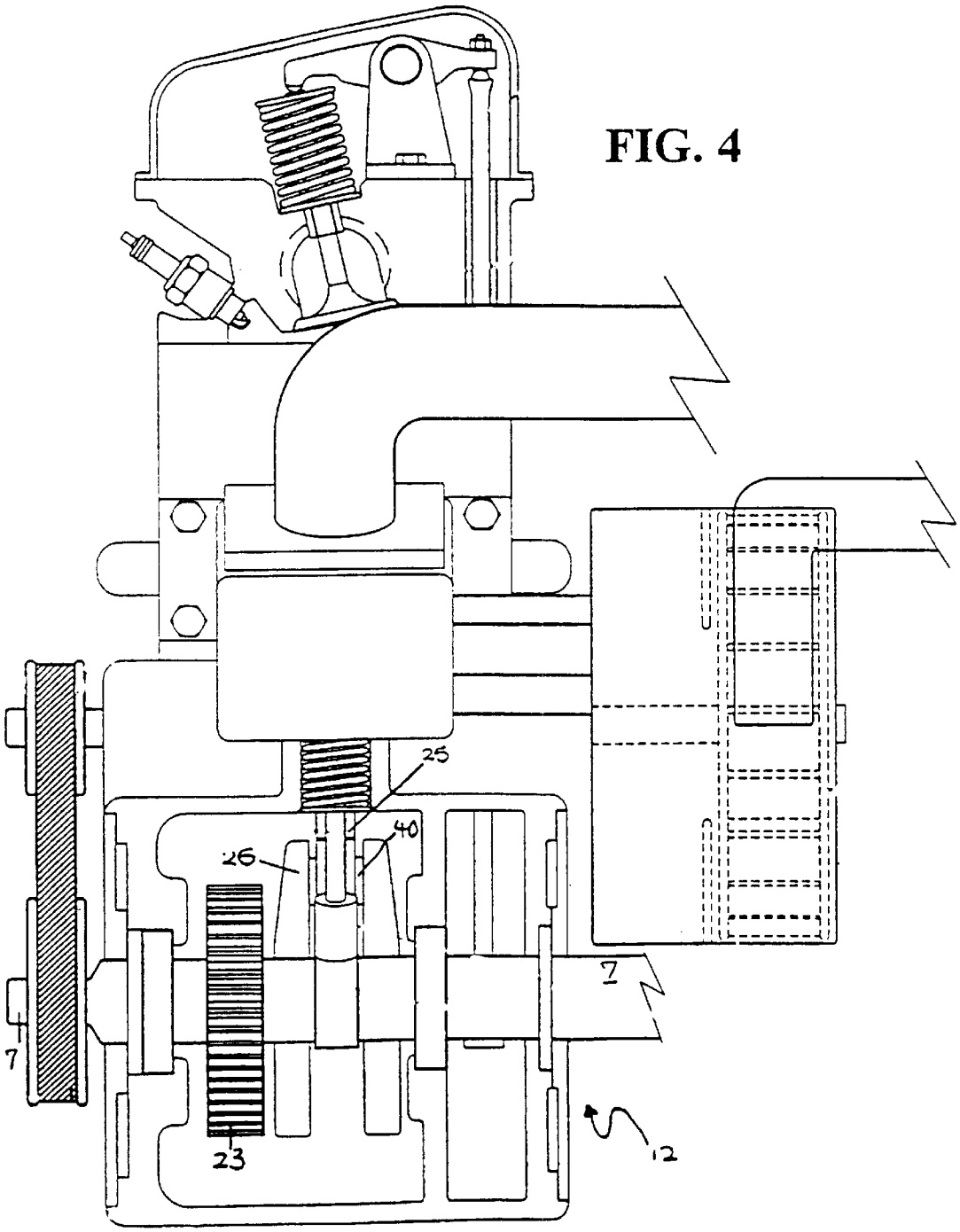
FIG. 4 illustrates a partially cut away side view of the engine of FIGS. 1 and 2.
Figure 5:
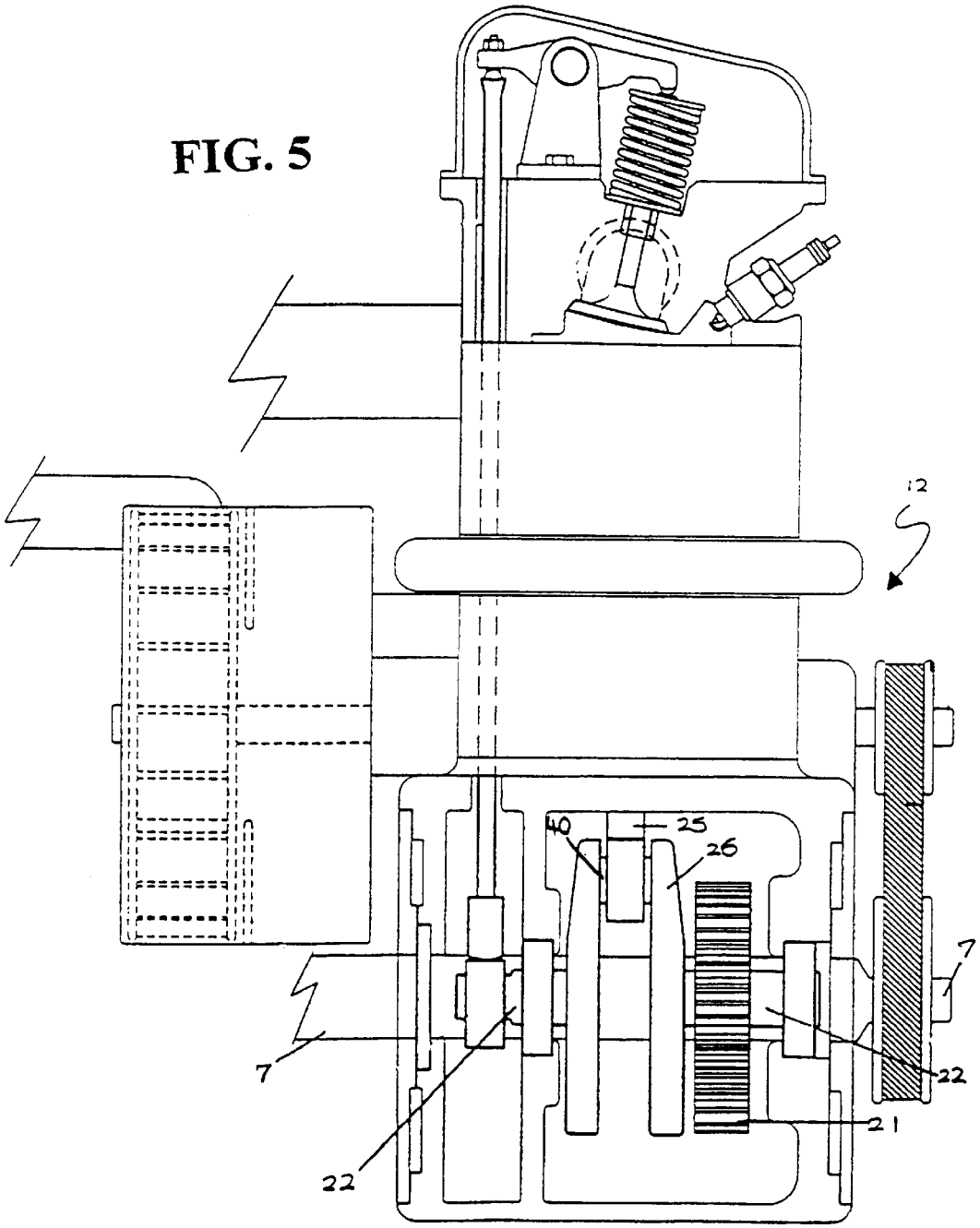
FIG. 5 illustrates a partially cut away side view of the engine of FIGS. 1 and 2 opposite to that shown in FIG. 4.
Figure 6:
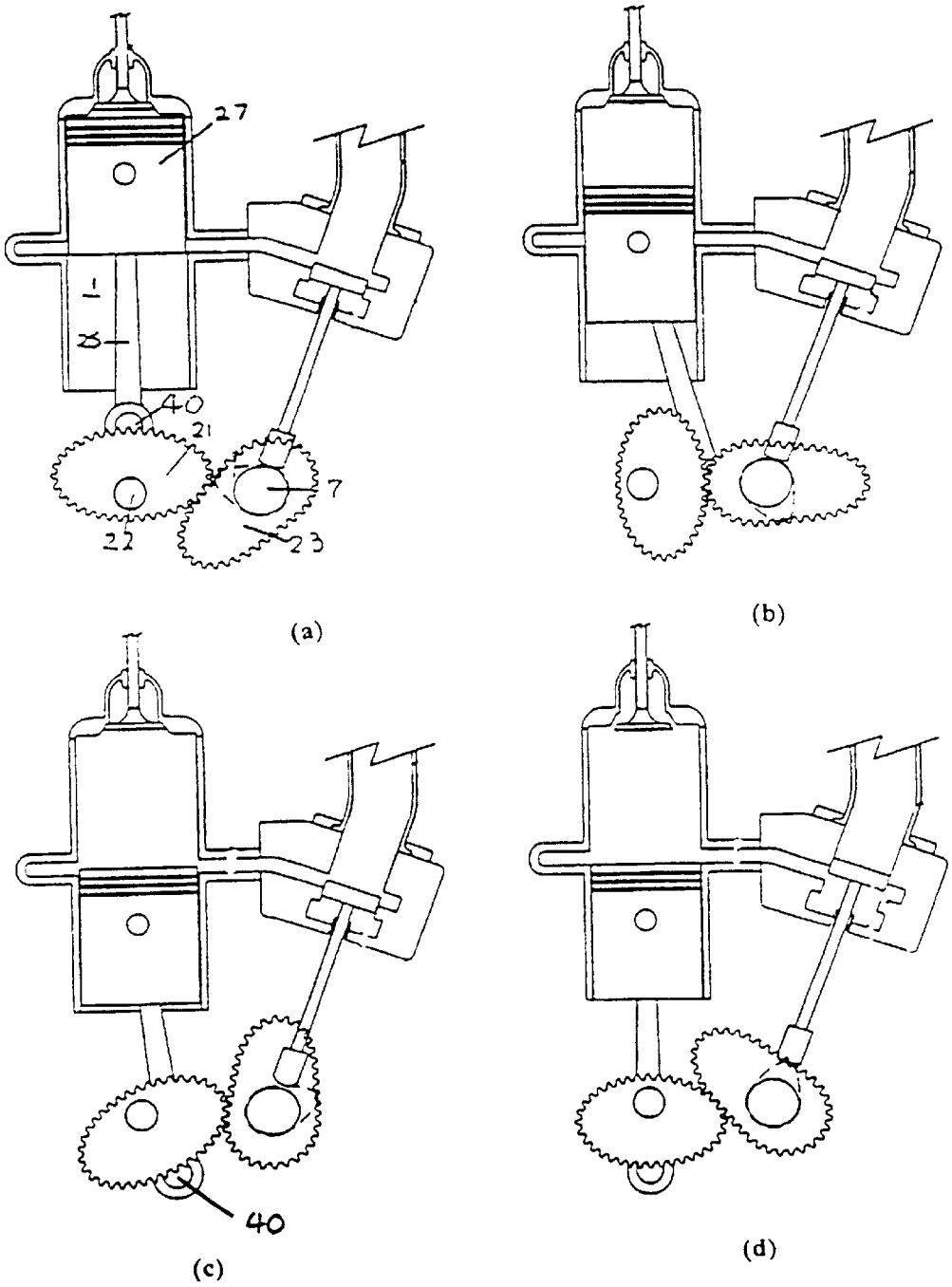
FIG. 6 illustrates a functional view of the operation of the engine shown in FIG. 2 during various instances during a stroke.

FIGS. 1 to 6 illustrate a two stroke internal combustion engine 12 according to the invention. Wherever possible, like reference numerals will be used to indicate like features.

The internal combustion engine 12 includes a drive shaft 7 and a crank 26 including a crank pin 40. A piston 27 is mounted for reciprocation within a cylinder 1 and a connecting rod 25 extends between the piston 27 and the crank pin 40. A first crank gear 21 mounted on the crank 26 and a first drive gear 23 is mounted on the drive shaft 7. Optionally, the crank gear 21 can be integrally formed with crank 26 and similarly, the drive gear may be integral with the drive shaft. The gears 21 and 23 form a first gear pair. It will be obvious that gear 23 is non-elliptical. However, in other forms one or the other may be elliptical or circular. It will be appreciated that a circle is a special form of an ellipse where the length of the major and minor axes are equal.

The drive gear 23 is engaged with the crank gear 21 such that reciprocation of the piston 27 causes rotation of the drive shaft in a relationship determined by the profiles of the crank gear and the drive gear. In the preferred form both the drive gear 23 and the crank gear 21 have an equal number of teeth 33. Consequently, one revolution of the crank gear produces one revolution of the drive shaft.

Figure 7:
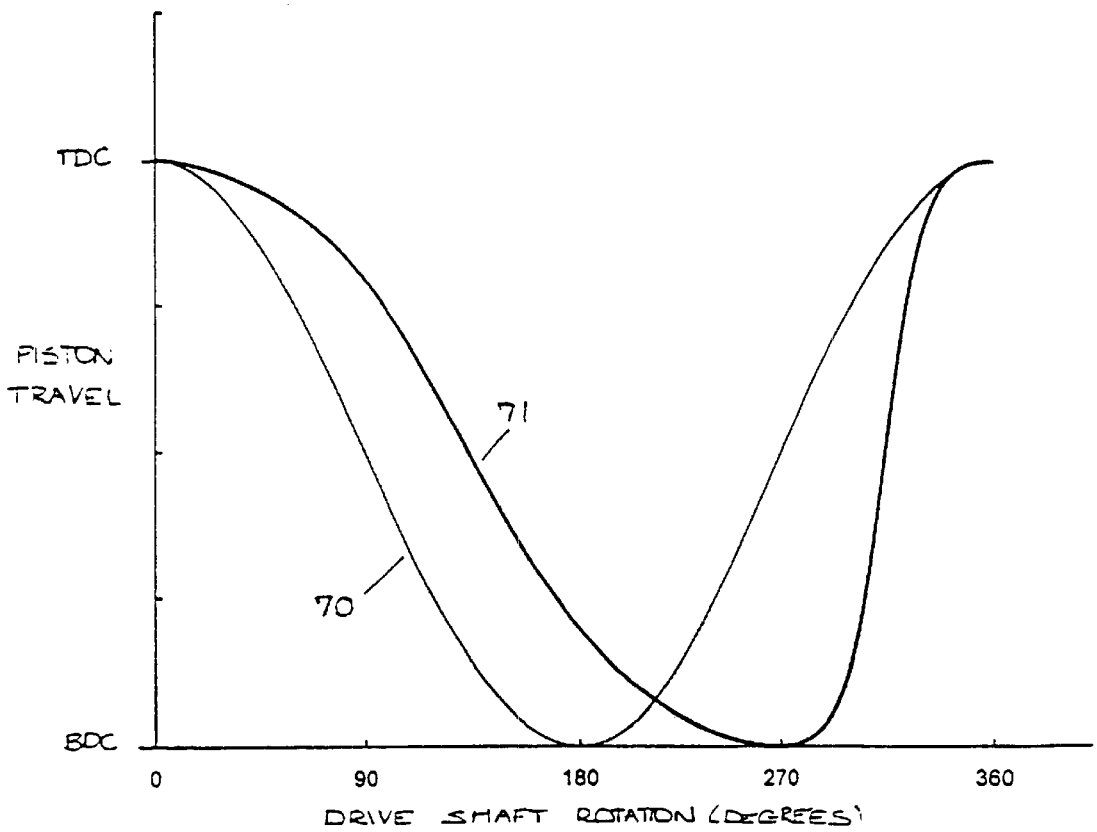
FIG. 7 illustrates the piston travel-drive shaft characteristic for both a conventional two stroke internal combustion engine and a two stroke internal combustion engine according to the invention.

In use, the engine illustrated in FIGS. 1 through 6 can achieve a piston travel drive shaft characteristic 71 as shown in FIG. 7. The typical sinusoidal characteristic provided by conventional engines is shown generally at 70. The particular profile or characteristic achieved by an engine according to the invention, and in practical terms the fashion in which linear movement of the piston 27 is converted to the rotation of the drive shaft 7, is affected by the selected shapes of the crank gear 21 and the drive gear 23. Also, the location at which the gears 21 and 23 are mounted to the crank 26 and the drive shaft 7 respectively can affect the profile achieved.

Figure 8:
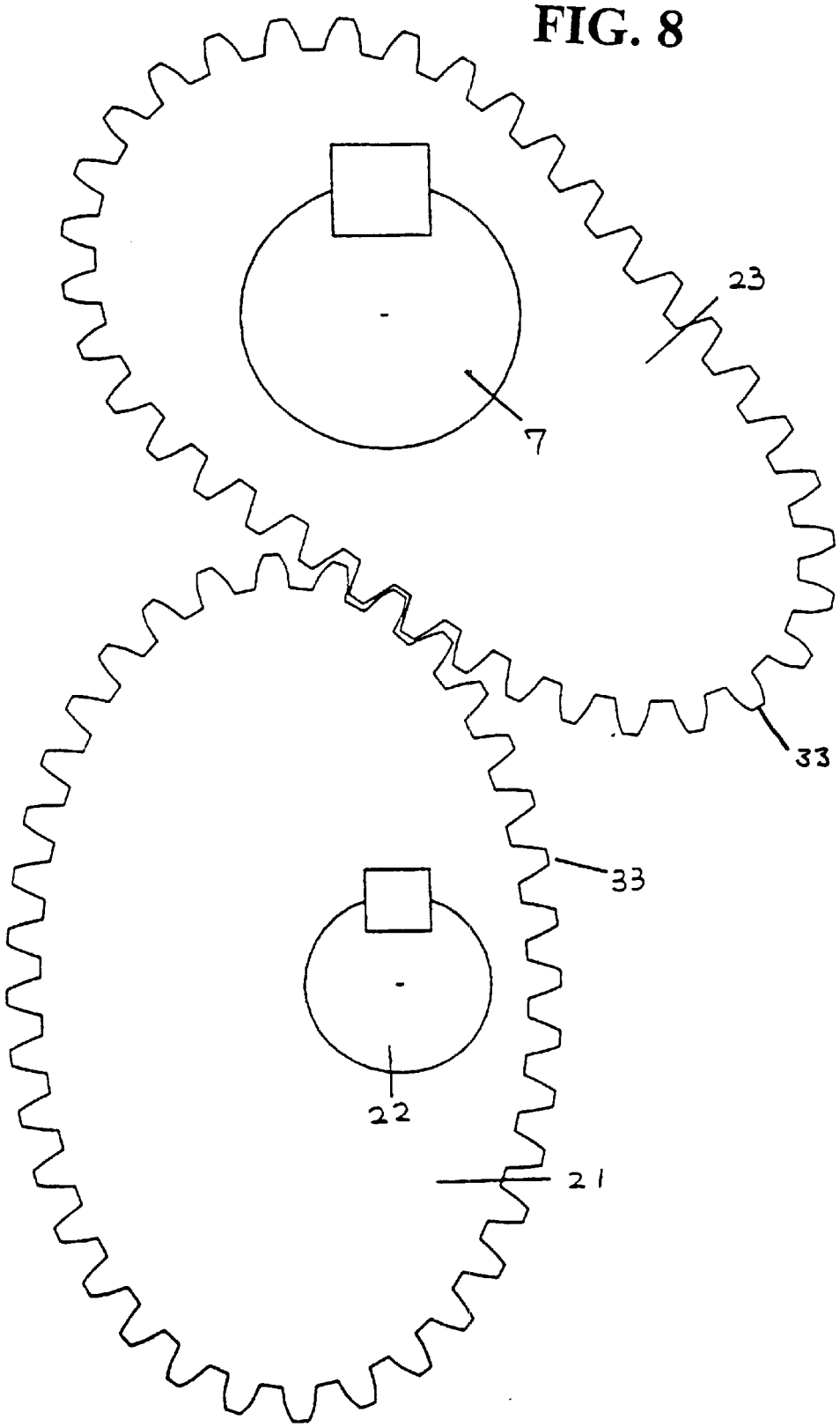
FIG. 8 illustrates an embodiment of a gear pair for an engine in accordance with the invention.

The particular embodiment shown in FIGS. 1 through 6 includes a crank gear 21 which is generally elliptical in shape. The axis 22 of rotation of the crank passes through crank gear 21 off the centre of the minor axis of the gear, as best seen in FIG. 8. The minor axis of gear 21 is parallel to the longitudinal centre line of crank 26.

Figure 9:
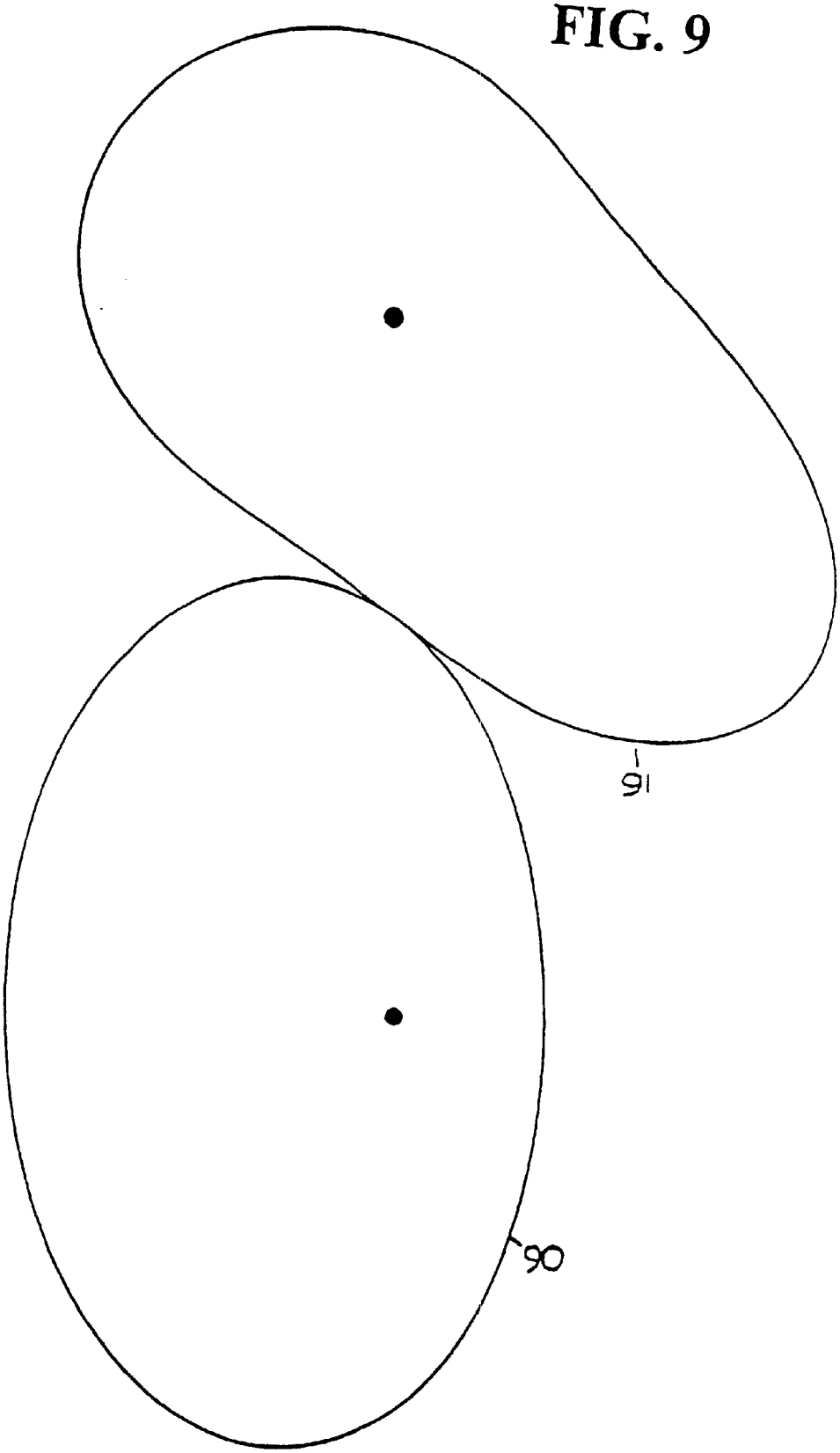
FIG. 9 illustrates the pitch circumference profile of the gear pair of FIG. 8.

The pitch circumference 91 of non-elliptical complementary drive gear 23 is indicated in FIG. 9 as is the pitch circumference 90 of crank gear 21. Also, drive gear 23 has the same number of teeth as crank gear 21. Consequently, one complete revolution of crank gear 21 produces one complete revolution of the drive shaft 7. The shape of drive gear 23 and the distance between the axis 22 of rotation of crank 26 and the drive shaft 7 are selectively determined so that gears 21 and 23 complete one rotation simultaneously, even though, at different stages during the rotation, the crank 26 will be rotating more quickly or more slowly than the drive shaft 7.

Advantageously, the piston 27 will move more slowly in the top dead centre (TDC) and bottom dead centre (BDC) regions and more quickly during a compression stroke when compared to a piston in a conventionally arranged engine. Once again, the profiles 70 and 71 indicating the piston travel drive shaft characteristic for conventional engines and engines according to the invention respectively are illustrated in FIG. 7.

The particular specifications of the crank gear 21 and the drive gear 23 are detailed below.

| CRANK GEAR 21 SPECIFICATIONS: | |
|---|---|
| Shape of Pitch | Elliptical<br>Semimajor axis 50 mm<br>Semiminor axis 30 mm |
| Pitch Circumference | 360 mm |
| Crankshaft Position | 12.68 mm off-center along the semiminor axis |
| Number of Teeth | 36 |
| Gear Type | American Standard Involute System - Stub Tooth |
| Circular Pitch | 10 mm |
| Pressure Angle | 20 degrees |
| Addendum | 2.546 mm |
| Dedendum | 3.183 mm |
| Backlash | 0.5 mm. |
| DRIVE GEAR 23 SPECIFICATIONS: | |
| Shape | Complement to Crank gear 21 |
| Pitch Circumference | 360 mm |
| Number of Teeth | 36 |
| Distance between Crankshaft and Drive shaft | 113.045 mm |

A further embodiment of the invention will now be further described, by way of example only, with general reference to FIGS. 10 to 16 inclusive. These figures illustrate another embodiment of the invention in the form of a four stroke internal combustion engine.

Once again, like reference numerals are used to indicate like features.

Figure 10:
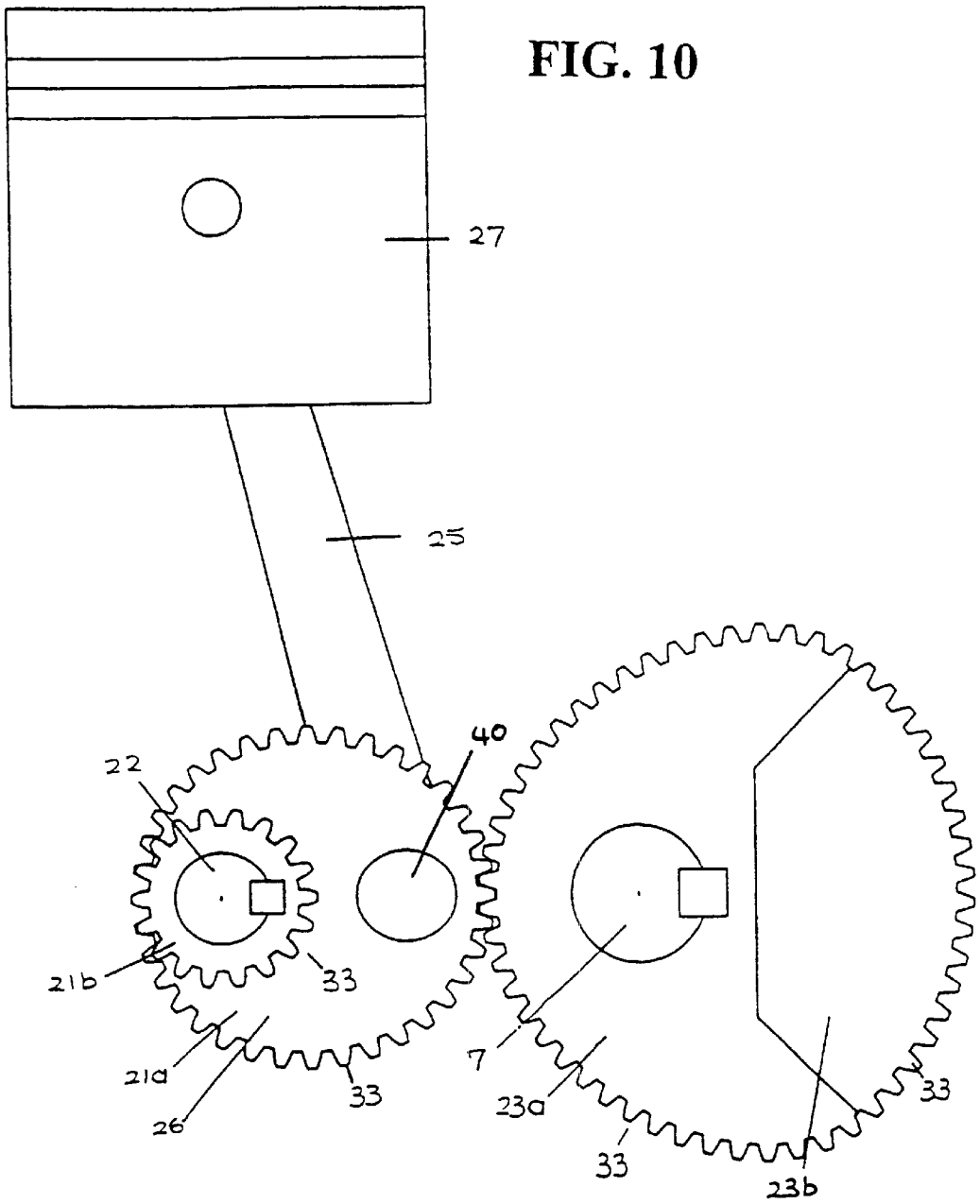
FIG. 10 illustrates a functional view of an embodiment of some of the components of a piston coupling in accordance with the invention suitable for use in a four stroke reciprocating internal combustion engine.

With reference to FIG. 10, the single cylinder four stroke engine includes a drive shaft 7 and a crank 26 including a crank pin 40. The crank has an axis of rotation 22. A connecting rod 25 extends between the piston 27 and the crank pin 40. In addition to the first gear pair, the engine also includes a second crank gear 21*b* mounted to the crank 26 and a second complementary drive gear 23*b* mounted to the drive shaft 7. The second crank gear 21*b* and the second drive gear 23*b* form a second gear pair. At least one of the second crank gear and the second drive gear is non-circular. Optionally both gears are non-circular.

The first drive gear 23*a* and the first crank gear 21*a* are engaged for a first portion of each complete revolution of the drive shaft. Similarly, the second drive gear 23*b* is engaged with the second crank gear 21*b* for a second complementary portion of each complete revolution of the drive shaft 7. In this manner, reciprocation of the piston 27 effects rotation of the drive shaft in a relationship determined by the profiles of the crank gears 21 a and 21*b* and the drive gears 23*a* and 23*b*, of the respective first and second gear pairs. It will be appreciated that in this embodiment, the first crank gear 21*a* also serves as the crank 26.

This gear arrangement causes linear movement of the piston 27 to be converted to rotational movement of the drive shaft 7 by at least the first gear pair during the first section of each revolution, and by at least the second gear pair during the second part of each complete revolution, of the drive shaft.

It will be appreciated that crank gears 21*a* and 21*b* have different circumferential lengths. Also, as shown to advantage in FIGS. 11, 13 and 14, first and second drive gears 23*a* and 23*b* have been joined to form a single gear having a first planar portion engaged with the first crank gear 21*a* for the duration of one complete revolution of the crank 26 and a second planar portion engaged with the second crank gear 21*b* for the duration of a subsequent complete revolution of the crank, providing one drive shaft revolution per two crank revolutions.

It will be readily appreciated from FIG. 10 that the first and second crank gears 21*a* and 21*b* are circular and the second crank gear 21*b* is centrally mounted about the axis 22 of rotation of the crank 26.

Figure 16:
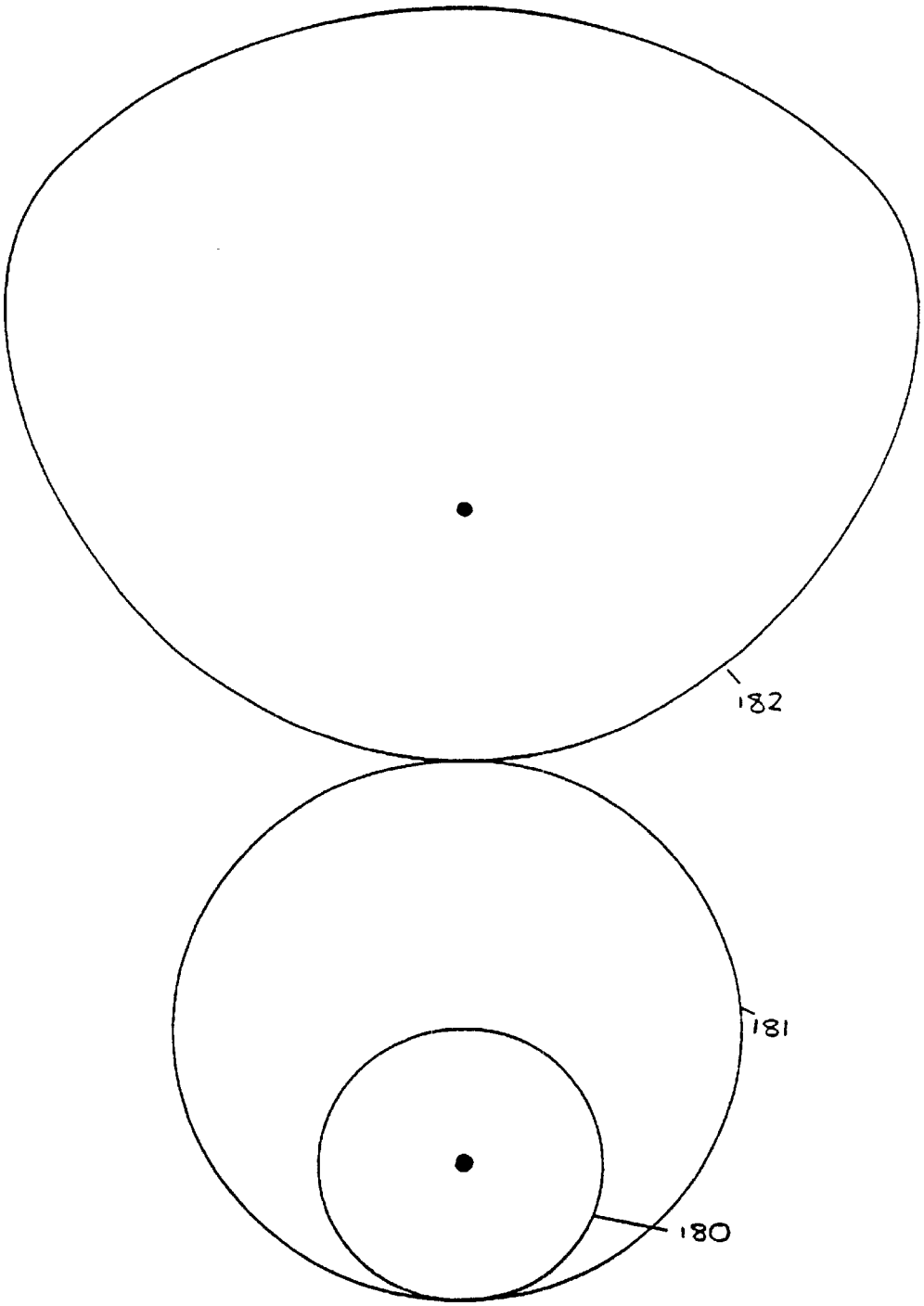
FIG. 16 illustrates the pitch circumference profile of the components in FIG. 15.

The first crank gear 21 a is mounted eccentrically about the axis 22 such that its pitch circle 181 touches the pitch circle 180 of the second crank gear 21*b* at one point as illustrated in FIG. 16. One further point to note with reference to FIG. 10 is that where gears 21*a* and 21*b* have a common tangent, ie at the extreme left hand side as illustrated in FIG. 10, the teeth 33 of each gear 21*a* and 21*b* are aligned. The pitch circumferences 181 and 180 of crank gears 21*a* and 21*b* form a continuous and closed curve through a rotation of 720°.

Figure 11:
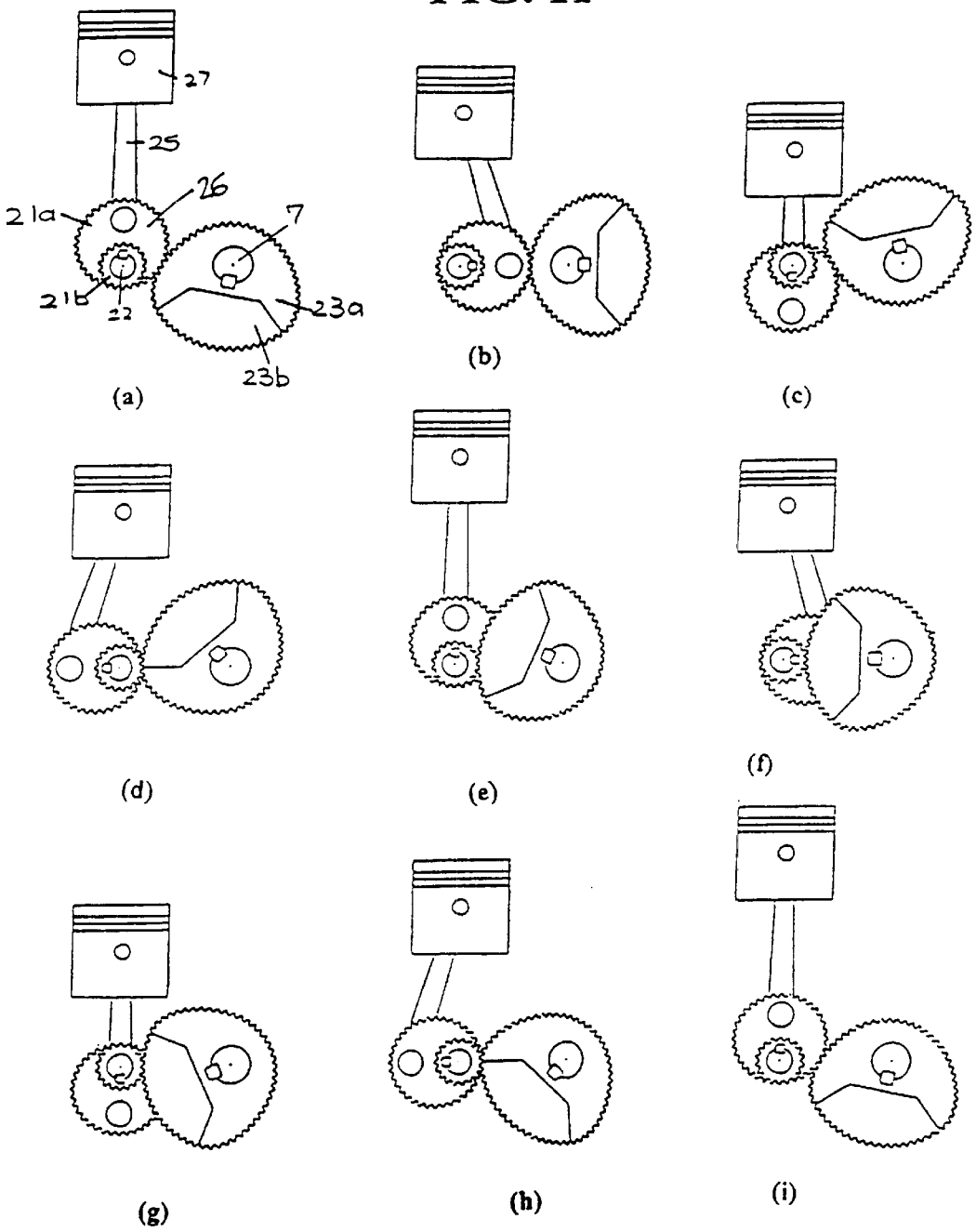
FIG. 11 illustrates a functional view of the operation of the piston coupling in FIG. 10 during various instances during a complete four stroke cycle.
Figure 12:
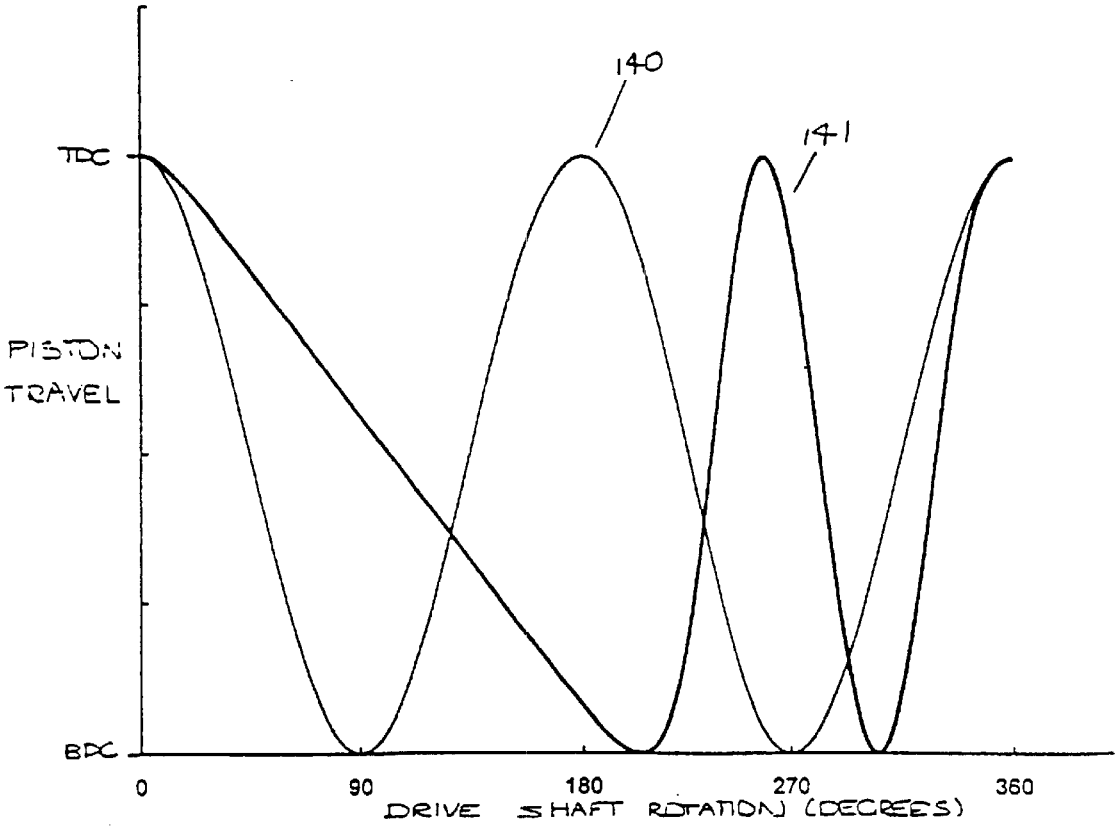
FIG. 12 illustrates a conventional and a selective piston travel-drive shaft characteristic in a four stroke internal combustion engine.
Figure 13:
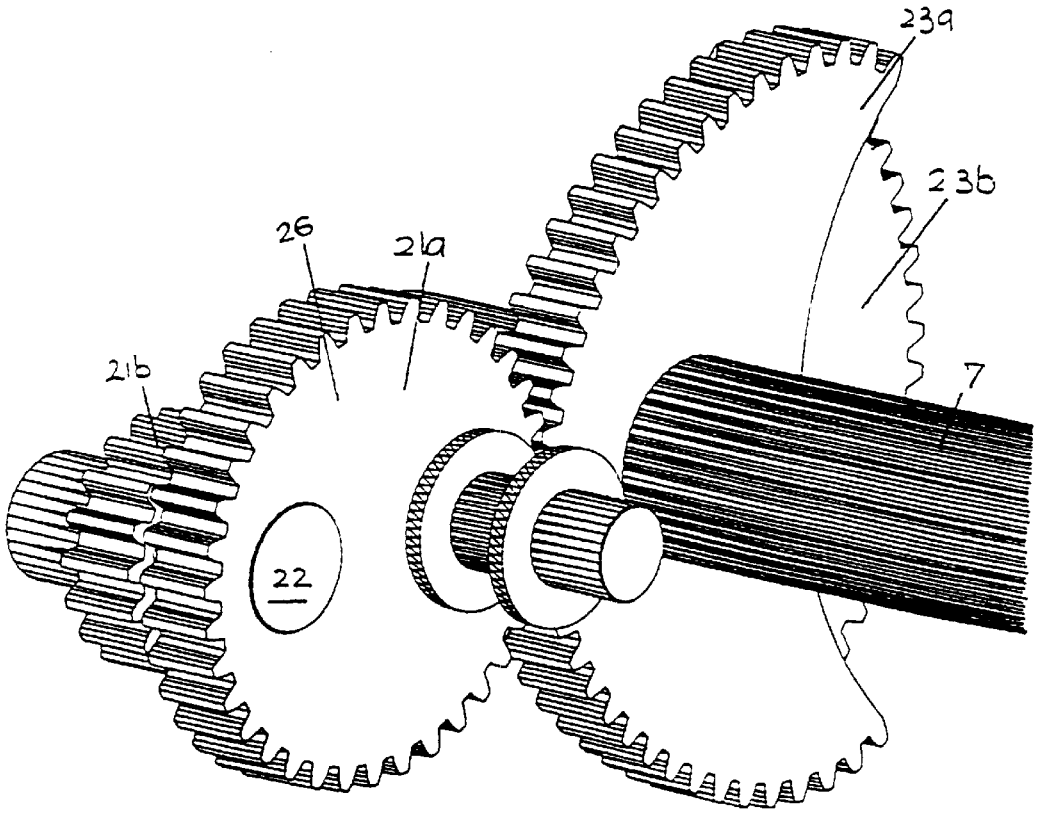
FIG. 13 illustrates a perspective view of an embodiment of some of the components of a piston coupling in accordance with the invention.
Figure 14:
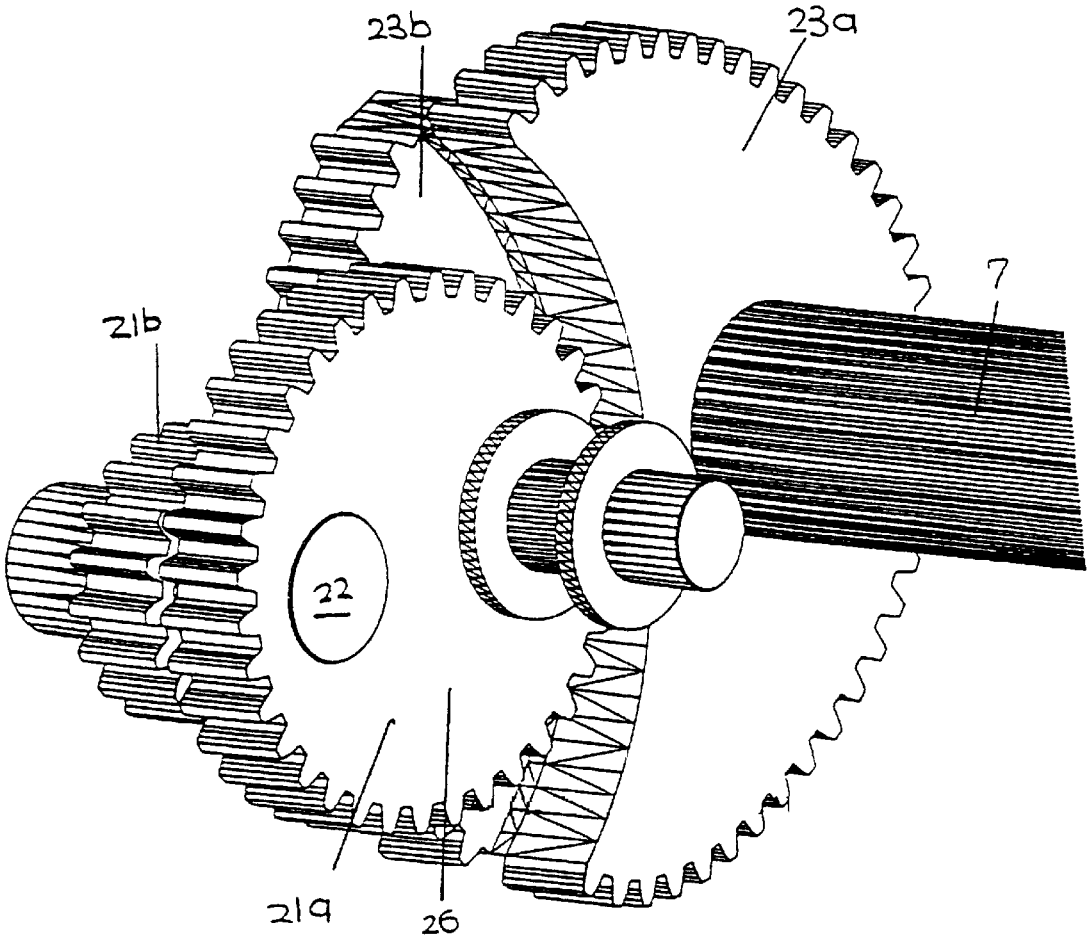
FIG. 14 illustrates an alternate perspective view to that shown in FIG. 13 during a different instance during operation.
Figure 15:
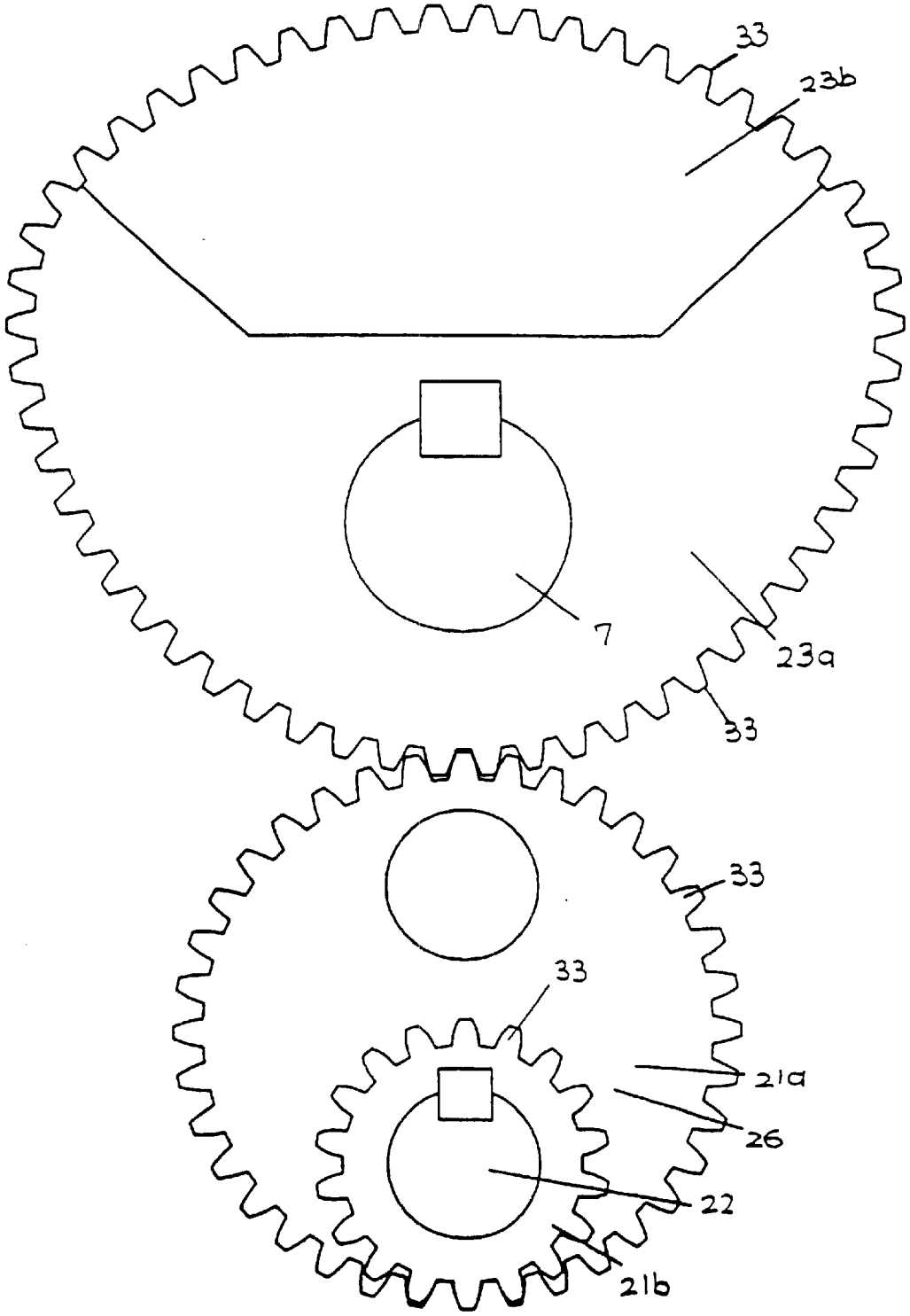
FIG. 15 illustrates an embodiment of some of the components of a piston coupling in accordance with the invention.

The two circular gears 21*a* and 21*b* mesh with drive gears 23*a* and 23*b* which, in combination, have a circumference of pitch circle 182 equal to the sum of the circumference of pitch circles 181 and 180 corresponding to first and second crank gears 21*a* and 21*b* respectively. The shape of drive gears 23*a* and 23*b* and the distance between the axis 22 and drive shaft 7 are selected by the requirement that two cycles of the piston 27 will result in one complete rotation of the drive shaft 7. This concept is illustrated in FIG. 11. The piston travel drive shaft characteristic 141 of a four stroke engine with the configuration described above is compared to the characteristic 140 of a conventional four stroke engine in FIG. 12.

The properties and dimensions of crank gears 21*a* and 21*b* drive gear 23*a* and 23*b* and the gear teeth 33 are tabulated below.

| | |
|---|---|
| Crank gear 21a | |
| Shape | Circular |
| Pitch Radius | 45.84 mm |
| Pitch Circumference | 288 mm |
| Crankshaft Position | 22.92 mm off center |
| Number of Teeth | 36 |
| Crankshaft Length | 48 mm (Distance between the centers of crankshaft 22 and the connecting rod journal) |
| Crank gear 21b | |
| Shape | Circular |
| Pitch Radius | 22.92 mm |
| Pitch Circumference | 144 mm |
| Crankshaft Position | center |
| Number of Teeth | 18 |
| Drive gear 23a | |
| Part 16: | |
| Shape | Open ovate |
| Pitch Length | 288 mm |
| Number of Teeth | 36 |
| Drive shaft Radius | 19.2 mm |
| Drive gear 23b | |
| Shape | Circular arc |
| Radius | 88.02 mm |
| Center | Center of drive shaft 22 |
| Number of Teeth | 18 |
| Pitch length | 144 mm |
| Center Distance (Between crank shaft 22 and drive shaft 7) | 97.01 mm |
| Gear Teeth 33 | |
| Type | American Standard Involute System - Stub Tooth |
| Circular Pitch | 8 mm |
| Pressure Angle | 20 degrees |
| Addendum | 2.0368 |
| Dedendum | 2.5464 mm |
| Backlash | 0.4 mm |

The use of the gear arrangement illustrated in FIGS. 10 through 16 may allow the relative duration of the power stroke in a four stroke engine to be modified when compared to the duration of the remaining three strokes.

Figure 17:
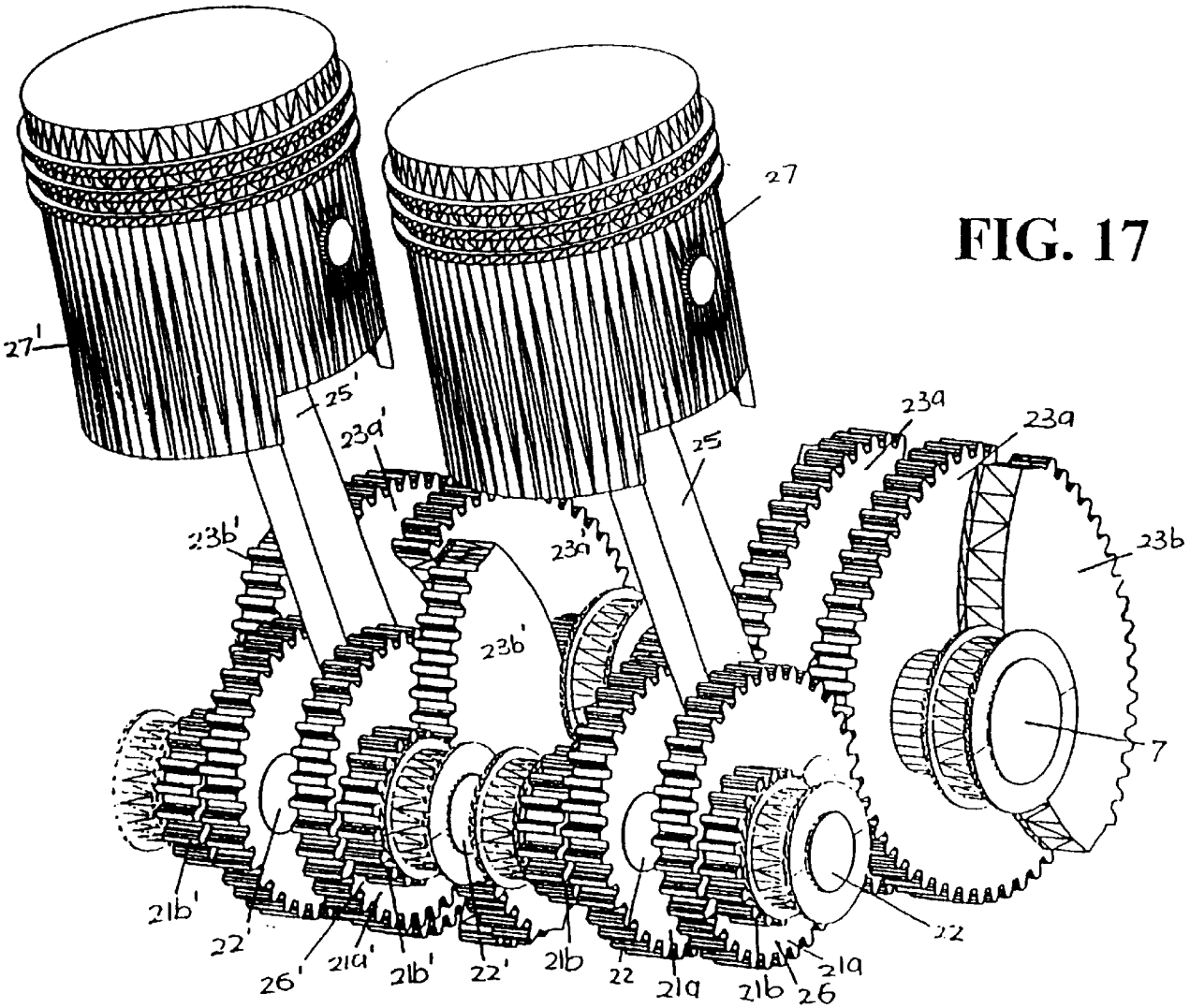
FIG. 17 illustrates a perspective functional view of an arrangement of two piston couplings in accordance with the invention suitable for use in a four stroke internal combustion engine.
Figure 18:
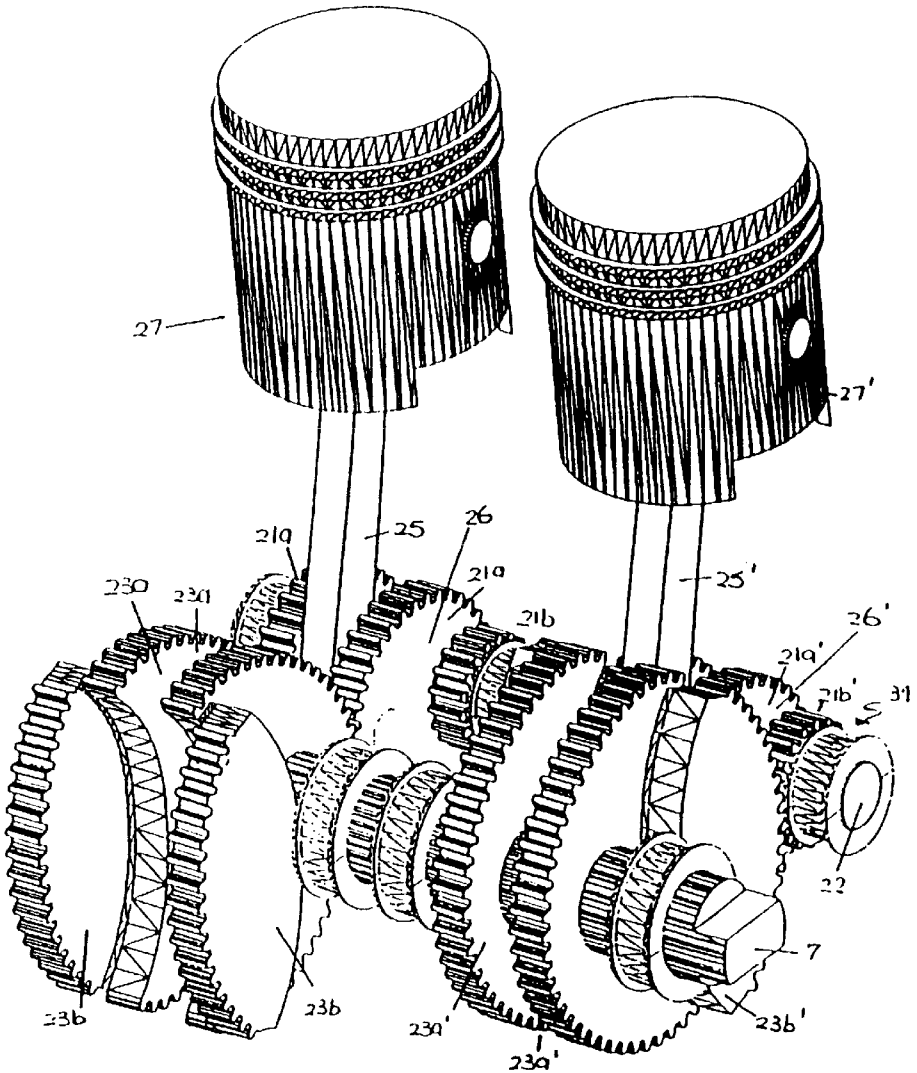
FIG. 18 illustrates the perspective view of FIG. 17 viewed from the other side.

FIGS. 17 and 18 illustrate a two cylinder engine according to the invention. In these figures, the features of the engine related to the second cylinder are denoted with a prime symbol, eg 23*a*'. However, there is only one drive shaft 7 and each of the drive gears 23*a*, 23*b* and 23*a*' and 23*b*' are fixed the drive shaft to provide selective phase or timing operation of piston 27 in relation in relation to piston 27'. It will be readily appreciated that such an arrangement may be extended to engines having more than two cylinders.

It will also be apparent that differently shaped crank gears and drive gears to those illustrated herein will provide alternative piston travel drive shaft characteristics which may be desirable for alternative applications. For example, it may be advantageous to slow the piston down when it is at the top of the drive stroke to allow more time for combustion under high pressure or, at the bottom of the intake stroke to allow more time for intake of air into the cylinder.

Although the invention has been described with reference to particular examples, it will be appreciated by those skilled in the art that the invention may be embodied in many other forms. For example, the crank and drive gears may not directly mesh but could alternatively be drivingly connected by a chain, a pulley, a toothed belt or an intermediate gear train.

What is claimed is:

1. An internal combustion engine including:

a drive shaft;

a crank including a crank pin;

a piston mounted for reciprocation within a cylinder;

a connecting rod extending between the piston and the crank pin;

a first crank gear mounted on the crank;

a first drive gear mounted on the drive shaft;

a second crank gear mounted to the crank; and a second complementary drive gear mounted to the drive shaft;

wherein the first crank gear and the first drive gear form a first gear pair;

wherein the first gear pair is drivingly engaged for at least a first portion of a complete revolution of the drive shaft;

wherein at least one of the first crank gear and the first drive gear of the first gear pair is non-elliptical, wherein reciprocation of the piston causes rotation of the drive shaft in a relationship determined by the respective profiles of the crank gear and the drive gear of the first gear pair;

wherein the second crank gear and second drive gear form a second gear pair;

wherein the second gear pair is drivingly engaged for at least a second complementary portion of a complete revolution of the drive shaft; and wherein at least one of the second crank gear and the second drive gear of the second gear pair is non-circular, wherein reciprocation of the piston causes rotation of the drive shaft in a relationship determined by the profiles of the crank gears and the drive gears of the respective first and second gear pairs.

2. The engine as claimed in claim 1, wherein the first and second crank gears are different in circumferential length, and the first and second drive gears are formed as a single composite gear having a first portion engaged with the first crank gear for the duration of one complete revolution of the crank, and a second portion engaged with the second crank gear for the duration of a subsequent complete revolution of the crank, providing one drive shaft revolution for every per two crank revolutions.

3. The engine as claimed in claim 1, wherein the crank gear and the drive gear of each gear pair are both non-circular.

4. The engine as claimed in claim 2, wherein at least one gear of each gear pair is eccentrically mounted.

5. The engine as claimed in claim 2, wherein both gears in each gear pair are eccentrically mounted.

* * * * *

UNITED STATES PATENT AND TRADEMARK OFFICE

CERTIFICATE OF CORRECTION

PATENT NO. : 6,401,683 B1 
DATED : June 11, 2002
INVENTOR(S) : Nigel Cameron Stokes et al.

It is certified that error appears in the above-identified patent and that said Letters Patent is hereby corrected as shown below:

Title page,
Item [30], Priority Data, "Feb. 20, 1919" should read -- Feb. 20, 1997 --.

Item [56], References Cited, OTHER PUBLICATIONS, add -- Patent Abstracts to Japan Publication No. JP 6-323,141, Publication date 11/22/94, entitled "Scavenging Mechanism for Two-Cycle Engine" Derwent Abstract Accession No. 96-441608/44, class Q 52. RU 2053391-C1 Jan. 27, 1996 --.

Signed and Sealed this

Twelfth Day of November, 2002

*Attest:*

*Attesting Officer*

JAMES E. ROGAN
*Director of the United States Patent and Trademark Office*